United States Patent [19]

Lew et al.

[11] Patent Number: 4,702,348

[45] **Date of Patent: * Oct. 27, 1987**

[54] SKY-RIDE VERTICAL MOBILITY SYSTEM

[76] Inventors: Hyok S. Lew; Hyon S. Lew; Yon K. Lew, all of 7890 Oak St., Arvada, Colo. 80005

[ * ] Notice: The portion of the term of this patent subsequent to Jul. 8, 2003 has been disclaimed.

[21] Appl. No.: 711,318

[22] Filed: Mar. 13, 1985

Related U.S. Application Data

[63] Continuation-in-part of Ser. No. 682,673, Dec. 17, 1984, Pat. No. 4,598,792, and a continuation-in-part of Ser. No. 676,400, Nov. 29, 1984, Pat. No. 4,598,793.

[51] Int. Cl.[4] ..... A62B 1/08

[52] U.S. Cl. ..... 182/42; 182/5; 182/72

[58] Field of Search ..... 182/42, 4–7, 182/231, 75, 236, 240, 71, 72, 190–193; 188/65.1–65.5

[56] References Cited

U.S. PATENT DOCUMENTS

| | | | |
|---|---|---|---|
| 194,625 | 8/1877 | Staples | 182/42 |
| 195,401 | 9/1877 | Riesdorph | 182/191 |
| 383,432 | 5/1888 | Bernstein | 182/6 |
| 636,264 | 11/1899 | Klinck | 182/42 |
| 682,082 | 9/1901 | Ives | 182/7 |
| 728,114 | 5/1903 | Kelly | 182/42 |
| 1,212,301 | 6/1917 | Wick | 182/6 |
| 1,578,108 | 3/1926 | Tobias | 182/42 |
| 1,616,924 | 2/1927 | Ratzer | 182/42 |
| 4,039,045 | 8/1977 | Hoger | 182/5 |
| 4,598,792 | 7/1986 | Lew | 182/42 |

FOREIGN PATENT DOCUMENTS

| | | | |
|---|---|---|---|
| 542390 | 12/1931 | Fed. Rep. of Germany | 182/5 |
| 858570 | 11/1940 | France | 182/3 |
| 2316975 | 11/1977 | France | 182/5 |

*Primary Examiner*—Reinaldo P. Machado
*Assistant Examiner*—Alvin Chin-Shue

[57] ABSTRACT

This invention relates to a device for transporting a person or persons vertically that comprises a closed loop of cord depending from a cylindrical roller with frictional braking means on which roller the cord is wound over a plurality of laps wherein the speed of the lowering motion of one member of the closed loop of cord depending from the cylindrical roller is effortlessly controlled by a small amount of tension exerted on the other member of the closed loop of cord depending from the cylindrical roller as the small amount of tension exerted on the other member of the closed loop of cord controls the magnitude of the frictional braking on the cylindrical roller. Consequently, a person secured to the one member of the closed loop of cord is able to lower oneself at a safe speed with ease by exerting a small amount of pull on the other member of the closed loop of cord. The cylindrical roller with frictional braking means equipped with a rachet means enables a person to raise as well as lower oneself with ease when secured to one member of the closed loop of cord and using a stirup means slidably secured to the other member of the closed loop of cord wherein the stirup locks onto the other member of the closed loop of cord when the weight of the person is exerted thereon.

14 Claims, 21 Drawing Figures

SKY-RIDE VERTICAL MOBILITY SYSTEM

This is a continuation-in-part application to patent application Ser. No. 682,673 entitled "Sky-Ride vertical mobility system" filed on Dec. 17, 1984, issued 7/1986, U.S. Pat. No. 4,599,792, and to patent application Ser. No. 676,400 entitled "Sky-Ride emergency escape system" filed on Nov. 29, 1984, issued 7/1986, U.S. Pat. No. 4,598,793.

BACKGROUND OF THE INVENTION

There has been a need of and demand for a portable device that enables a person to lower oneself and/or raise oneself vertically without struggling in time of emergency as well as in leisure, which device is compact and light-weight enough to be carried around and deployed by a single person. High-rise office buildings and apartment buildings can be compared to an ocean liner without life beats, as present day high-rise buildings do not possess means and ways to rescue the occupants from serious fires which render stairways, elevators and other emergency exit means unusable. Of course, ladders on fire trucks can bring down the occupants located at the lower levels and helicopters can pluck off people from the top of the high-rise buildings. However, the efficiency and effectiveness of rescue operations using fire truck ladders and helicopters are highly questionable. The simple truth is that there is no means available in the United States today for rescuing occupants trapped in the middle levels of high-rise buildings during fire emergency. The present invention provides a self-sufficient device for lowering oneself from any level of a high-rise building without depending on any other people or institutions during an emergency, which device can be owned, stored and operated by the user himself. The apparatus of the present device can also be used by mountain climbers, spelunkers, outdoor activists, rescue crews, military, etc.

The primary object of the present invention is to provide a compact and light-weight device for lowering oneself from an elevated structure.

Another object is to provide a device comprising a closed loop of cord wound on a cylinder with frictional braking means over a plurality of laps and depending therefrom wherein the speed of the lowering motion of one member of the closed loop of cord depending from the cylinder with frictional braking means is controllable with a small amount of pull exerted on the other member of the closed loop of cord depending from the cylinder with frictional braking means.

A further object is to provide a compact and light-weight device for lowering and raising oneself vertically.

Yet another object is to provide a vertical mobility system comprising a closed loop of cord wound on a cylinder with one way frictional braking means over a plurality of laps and depending therefrom wherein the speed of the lowering motion of one member of the closed loop of cord depending from the cylinder with frictional braking means is controllable with a small amount of pull exterted on the other member of the closed loop of cord depending from the cylinder with frictional braking means, while the lowering motion of the other member of the closed loop of cord is not frictionally braked by a tension exerted on the one member of the closed loop of cord.

Yet a further object is to provide a vertical mobility system comprising a harness secured to the one member of the closed loop of cord and a stirrup slidably secured to the other member of the closed loop of cord wherein the stirrup locks onto the other member of the closed loop of cord when the weight of the person supported by the harness is exerted on the sitrrup.

These and other objects of the present invention will become clear as the description thereof proceeds.

BRIEF DESCRIPTION OF THE FIGURES

The present invention may be described with a clarity and specificity by referring to the following figures.

DESCRIPTION OF THE ILLUSTRATED EMBODIMENTS

Figure 1:
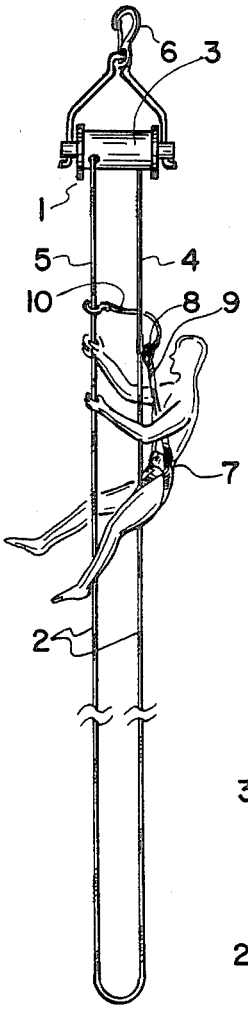
FIG. 1 illustrates a perspective view of an embodiment of the present invention being used by a person lowering oneself therewith.

In FIG. 1 there is illustrated a perspective view of an embodiment of the sky-ride vertical mobility system constructed in accordance with the principles of the present invention comprising a frictionally controlled cord release device 1 and a closed loop of cord 2 depending therefrom. The frictionally controlled cord release device 1 includes a friction cylinder or friction roller cylinder enclosed within the tubular guide 3. The closed loop of cord 2 is wound on the friction roller or friction roller cylinder over a plurality of laps wherein the first cord member 4 and the second cord member 5 of the closed loop of cord 2 exit through the tubular guide 3 and are suspended downward from the frictionally controlled cord release device 1 secured to an elevated structure by means of a securing means 6. As to be described in conjunction with FIGS. 2 through 19, the frictionally controlled cord release device 1 includes a frictional braking means that controls the speed of the looping movement of the closed loop of cord 2 relative to the frictionally controlled device 1 wherein the magnitude of frictional braking is controlled by a small amount of pull exerted on one cord member of the closed loop of cord 2. As a consequence, a person secured to the first cord member 4 of the closed loop of cord 2 by means of a harness 7 tethered thereto is able to lower oneself with ease at a safe speed by maintaining a small amount of pull on the second cord member 5 of the closed loop of cord 2. The first cord member 4 of the closed loop of cord 2 includes a securing means 8 affixed thereto for removably securing the tether 9 extending from the harness 7 as well as the safety cord 10 with the free extremity thereof slidably secured to the other cord member 5. The purpose of the safety cord 10 is to help the person secured to the first cord member 4 to grap back the second cord member 5 if one accidentally loses one's hold onto the second cord member 5 during one's descending.

Figure 2:
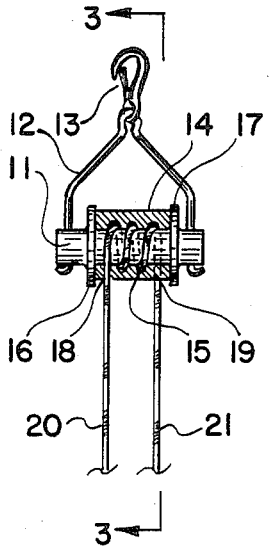
FIG. 2 illustrates a two-way frictionally controlled cord release device including a friction cylinder from which the closed loop of cord depends.

In FIG. 2 there is illustrated one of the simplest embodiments of the frictionally controlled cord release device usable in place of the element 1 shown in FIG. 1, which device comprises a friction cylinder 11 nonrotatably supported by a frame 12 including a securing means 13 for anchoring the device to an elevated structure, and a tubular cord guide 14 including a helical guide groove 15 formed on the inner cylindrical surface thereof rotatably mounted on the friction cylinder 11. The tubular cord guide 14 rotatably retained on the friction cylinder 11 by means of a pair of flanges 16 and 17 affixed thereto includes a pair of holes 18 and 19 disposed through the wall thereof, which holes provide passages for two cord members 20 and 21 of the closed loop of cord wound on the friction cylinder 11 over a plurality of laps following the helical guide groove 15 and depending therefrom. A small amount of tension on one of two cord members 20 and 21 creates friction between the friction cylinder 11 and the cord member wound thereon large enough to suspend a heavy weight secured to the other of two cord members in midair. By varying the magnitude of the small amount of tension exerted on one of two cord members by a person suspendedly secured to the other of two cord members, that person is able to control one's descending speed from zero to any other safe value without struggling and lowers oneself safely to the ground as shown in FIG. 1.

Figure 3:
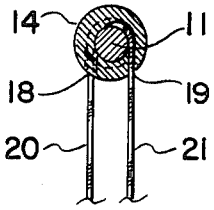
FIG. 3 illustrates a cross section of the device shown in FIG. 2.

In FIG. 3 there is illustrated a cross section of the device shown in FIG. 2 taken along a plane 3—3 as shown in FIG. 2. It is quite clear that the device shown in FIGS. 2 and 3 is a two-way frictionally controlled cord release device as there is no mechanical distinction between the looping movements of the closed loop of cord relative to the friction cylinder in two opposite directions.

Figure 4:
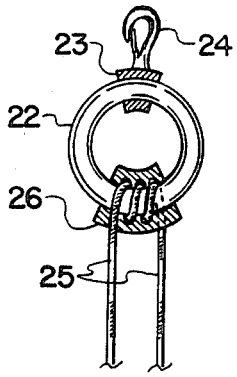
FIG. 4 illustrates a two-way frictionally controlled cord release device including a friction cylinder of annulus shape from which the closed loop of cord depends.

In FIG. 4 there is illustrated another embodiment of the two-way frictionally controlled cord release device that comprises a friction ring 22 rotatably supported by a supporting structure 23 including a securing means 24, and a closed loop of cord 25 wound thereon over a plurality of laps and depending therefrom wherein the curved tubular cord guide 26 constructed in essentially the same manner as the element 14 of FIG. 2 separates individual laps of the cord member wound on the friction ring from each other.

Figure 5:
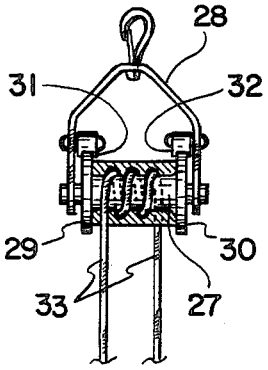
FIG. 5 illustrates a one way frictionally controlled cord release device including a friction cylinder equipped with ratchet means from which the closed loop of cord depends.

In FIG. 5 there is illustrated a one-way frictionally controlled cord release device constructed in essentially the same manner as the device shown in FIG. 2 with a few exceptions being that, firstly, the friction roller cylinder 27 is rotatably supported by the supporting structure 28 and, secondly, the pair of flanges 29 and 30 affixed to the friction roller cylinder 27 have teeth and are respectively engaged by a pair of the ratchet stops 31 and 32 affixed to the supporting structure 28. As a consequence, the friction roller cylinder 27 plays the role of a rotating sheave in enhancing the looping movement of the closed loop of cord 33 in one direction, while it plays the same role of a friction cylinder as the element 11 of FIG. 2 in hindering the looping movement of the closed loop of cord 33 in the other direction. For this reason, the device shown in FIG. 5 is called a one-way frictionally controlled cord release device in contrast to the two-way frictionally controlled cord release device shown in FIG. 2 or 4. It should be understood that only a single ratchet mechanism instead of a pair as shown in the illustrated embodiment may be employed in constructing the one-way frictionally controlled cord release device.

Figure 6:
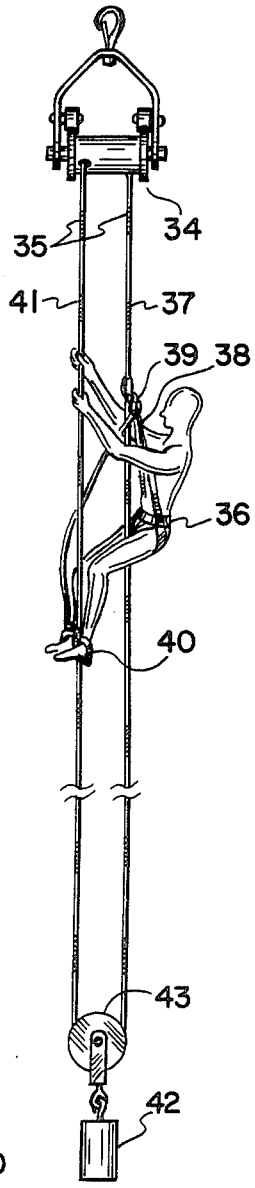
FIG. 6 illustrates a perspective view of an embodiment of the present invention including a one-way frictionally controlled cord release device that is being used by a person raising oneself therewith.

In FIG. 6 there is illustrated a perspective view of another embodiment of the sky-ride vertical mobility system constructed in accordance with the principles of the present invention, that comprises a one-way frictionally controlled cord release device 34 similar to the device shown in FIG. 5 and a closed loop of cord 35 wound on the friction roller cylinder included in the one-way frictionally controlled cord release device 34 and depending therefrom. A harness 36 supporting a person is removably secured to the first cord member 37 by means of a tether 38 extending from the harness 36 attached to a securing means 39 affixed to the first cord member 37, while a stirrup device 40 is slidably secured to the second cord member 41 and is tethered to the securing means 39 affixed to the first cord member 37 of the closed loop of cord 35. The stirrup device 40 slides over the second cord member 41 freely as long as the person secured to the first cord member 37 does not exert one's weight on one's feet engaging the stirrup device, while the stirrup device locks up onto the second cord member 41 when the weight of the person is exerted on the stirrup device 40. The weight 42 suspended from a sheave 43 engaged by the lower extremity of the closed loop of cord 35 is to provide a residual tension on the second cord member 41 that facilitates the sliding movement of the stirrup device 40. In practice of the invention, the stirrup device 40 as well as the sheave 43 should be designed in such a way that those elements can be removed from the closed loop of cord 35. The ratchet mechanism included in the one-way frictionally controlled cord release device 34 is installed in such a way that the looping movement of the closed loop of cord 35 in one direction resulting in the downward movement of the first cord member 37 is hindered by the frictional braking provided by the friction roller cylinder of the frictionally controlled cord release device 34, while the looping movement in the other direction resulting in the down-ward movement of the second cord member 41 is unhindered by the frictional braking. To lower oneself at a safe speed, all one has to do is maintain a small amount of pull on the second cord member 41 without exerting any pressure on the stirrup device 40. In fact, one does not even need to keep one's feet engaged in the stirrup device 40 during descending operation. To raise oneself, firstly, one pulls up the stirrup device 40 with one's feet engaged therein by bending one's knee while maintaining small amount of pull on the second cord member 41 and, secondly, one stands up on one's feet engaging the stirrup 40 by straightening one's knee that will result in raising oneself over a distance equal to one half of that the stirrup device 40 was initially pulled up. By repeating the movement of pulling up the stirrup device by bending the knee and standing up on the stirrup device by straightening the knee, one raises oneself with ease. The sky-ride vertical mobility system as illustrated in FIG. 6 enables a human being to raise and lower oneself with ease following two cord members depending from the one-way frictionally controlled cord release device just like its predecessor ape climbing and riding down vines in the jungle!

Figure 7:
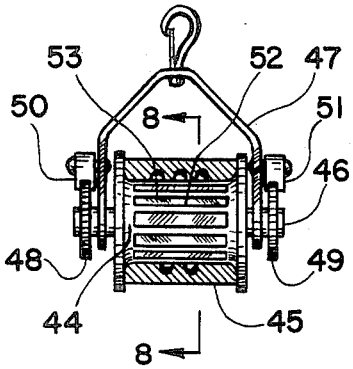
FIG. 7 illustrates a one-way frictionally controlled cord release device including a friction cylindrical roller equipped with ratchet means from which the closed loop of cord depends.

In FIG. 7 there is illustrated another embodiment of the one-way frictionally controlled cord release device comprising a friction roller cylinder 44 with a tubular cord guide 45 rotatably mounted on a shaft 46 that is rotatably supported by the supporting structure 47. A pair of gears or sprockets 48 and 49 nonrotatably mounted on the shaft 46 are respectively engaged by a pair of ratchet stops 50 and 51 secured to the supporting structure 47. The cylindrical shell of the friction roller cylinder 44 includes a plurality of cutouts 53 movably engaged by a plurality of filler blocks 54, respectively.

Figure 8:
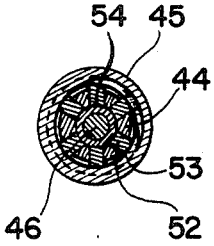
FIG. 8 illustrates a cross section of the device shown in FIG. 7.

In FIG. 8 there is illustrated a cross section of the device shown in FIG. 7 taken along a plane 8—8 as shown in FIG. 7. A collapsible brake pad 54 is disposed within the annular space intermediate the hollow friction roller cylinder 44 and the shaft 46. The tension on the cord member wound on the friction roller cylinder squeezes the filler blocks 54 movably engaging the cutouts 53 disposed through the cylindrical shell of the friction roller cylinder 44 and squeezes the collapsible brake pad 54 against the cylindrical surface of the shaft 46, which action results in braking between the friction roller cylinder 44 and the shaft 46. The one-way braking is provided because the shaft 46 is secured to the supporting frame 47 in one direction only by the ratchet stops 50 and 51, while the shaft is free to rotate in the other direction. The advantage provided by device shown in FIGS. 7 and 8 is in the elimination of the slipping motion between the cord member and the friction roller cylinder and, consequently, reducing of the wear on the cord member. It is clear that the collapsible brake pad 54 can be eliminated when the surfaces of the filler blocks 53 in contact with the cylindrical surface of the shaft 46 is lined with brake linings. The one-way frictionally controlled cord release device shown in FIG. 7 may be employed in place of the element 34 shown in FIG. 6.

Figure 9:
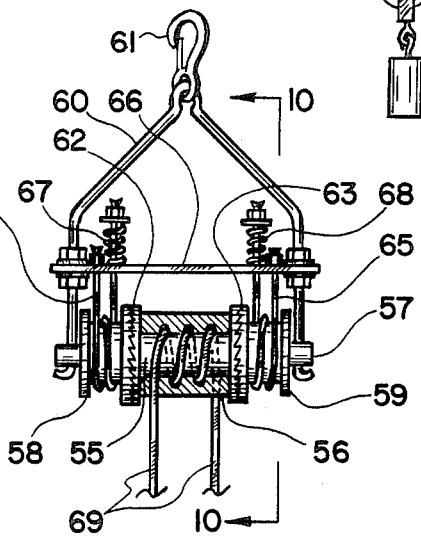
FIG. 9 illustrates a one-way frictionally controlled cord release device including means for adjusting the magnitude of frictional braking.

In FIG. 9 there is illustrated a one-way frictionally controlled cord release device including means for adjusting the magnitude of frictional braking on the friction roller cylinder independent of the tension on the cord member wound on the friction roller cylinder. In embodiments of the frictionally controlled cord release devices shown in FIGS. 2, 4, 5 and 7, the magnitude of frictional braking increases without limit with the increasing weight of the closed loop of cord depending from the friction cylinder and, consequently, those devices are not usable when the length of the closed loop of cord depending therefrom is very long and becomes very heavy. The one-way frictionally controlled cord release device shown in FIG. 9 is to eliminate the aforementioned problem, which comprises a friction roller cylinder 55 with a tubular cord guide 56 rotatably mounted on a shaft 57 intermediate a pair of brake roller cylinders 58 and 59 also rotatably mounted on the shaft 57 supported by the supporting structure 60 with a securing means 61. The friction roller cylinder 55 is coupled with the pair of brake roller cylinders 58 and 59 by ratchet coupling 62 and 63, respectively. The pair of brake cords 64 and 65 are respectively wound on the collapsible brake linings wrapped around the cylindrical surfaces of the brake roller cylinders 58 and 59 and are anchored to a brake cord holder 66 affixed to the supporting structure 60 wherein a pair of spring biases 67 and 68 maintain a certain level of tension on the pair of the brake cords 64 and 65 all the time. As the ratchet coupling 62 and 63 allow a free rotation of the friction roller cylinder 55 in one direction, the closed loop of cord 69 is allowed to loop freely in one direction, while the looping movement of the closed loop of cord 69 in the other direction is subjected to frictional braking by the brake cords 64 and 65. By adjusting the distance between the brake cord holder 66 and the shaft 57, one can set a proper magnitude of braking independent of the weight of the closed loop of cord, that may be set to a value from five to ten pounds less than the weight of the person using the sky-ride vertical mobility system shown in FIG. 6 wherein the element 34 is now replaced by the one-way frictionally controlled cord release device shown in FIG. 9. It should be understood that only a single brake roller cylinder instead of a pair as shown in the illustrated embodiment may be employed in the construction of the frictionally controlled cord release device.

Figure 10:
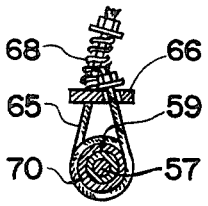
FIG. 10 illustrates a cross section of the device shown in FIG. 9.

In FIG. 10 there is illustrated a cross section of the device shown in FIG. 9 taken along a plane 10—10 as shown in FIG. 9, which illustrates the installation of the collapsible brake lining 70 wrapped around the brake roller cylinder 59.

Figure 11:
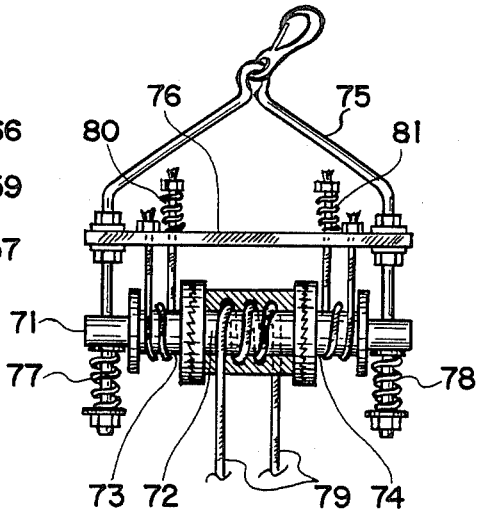
FIG. 11 illustrates a one-way frictionally controlled cord release device including means for automatically controlling the magnitude of frictional braking as a function of the weight depending therefrom.

In FIG. 11 there is illustrated another one-way frictionally controlled cord release device constructed essentially in the same way as the device shown in FIG. 9 with one exception being that the shaft rotatably supporting the friction roller cylinder 72 and the pair of the brake roller cylinder 73 and 74 is movable secured to the supporting structure 75 wherein the relative position of the shaft 71 with respect to the brake cord holder 76 is spring biased by a pair of the compression springs 77 and 78. The pair of compression springs 77 and 78 are initially adjusted to counter-balance the weight of the closed loop of cord 79, while the pair of compression spring biases 80 and 81 employed in anchoring the pair of the brake cords to the brake cord holder 76 are selected to provide a frictional braking force automatically varying in proportion with the weight of the person secured to the closed loop of cord 79, that is from five to ten pounds less than the weight of that person.

Figure 12:
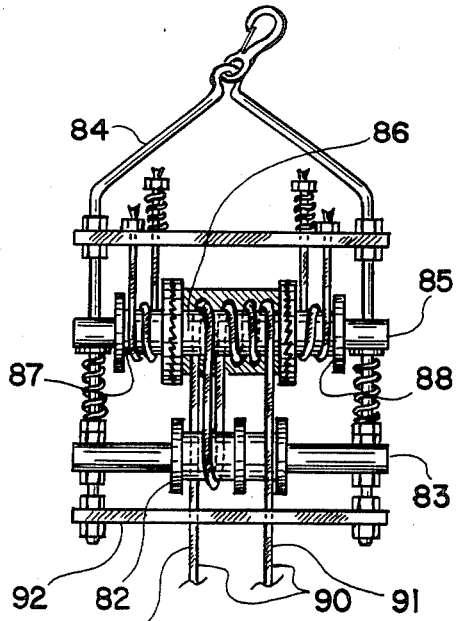
FIG. 12 illustrates a one-way frictionally controlled cord release device wherein the magnitude of the frictional braking is sensitively controlled by the weight depending therefrom.

In FIG. 12 there is illustrated a further one-way frictionally controlled cord release device that comprises all the elements included in the device shown in FIG. 11 plus an idler roller 82 rotatably mounted on a shaft 83 affixed to the supporting structure 84 in a parallel relationship with respect to the shaft 85 rotatably supporting the friction roller cylinder 86 and the pair of the brake roller cylinder 87 and 88. The first cord member 89 of the closed loop of cord 90 supporting the person secured thereto, which cord member 89 depends from the friction roller cylinder 86, is looped around the combination of the idler roller 82 and the friction roller cylinder 86 and routed back downward, while the second cord member 91 is routed downward directly after the cord member is wound on the friction roller cylinder over a plurality of laps. A cord guide plate 92 may be included that guides the cord members through the holes disposed therethrough. In this embodiment, the magnitude of braking force is more sensitively adjusted as a function of the weight of the person secured to the cord member 89 in an automatic relationship.

Figure 13:
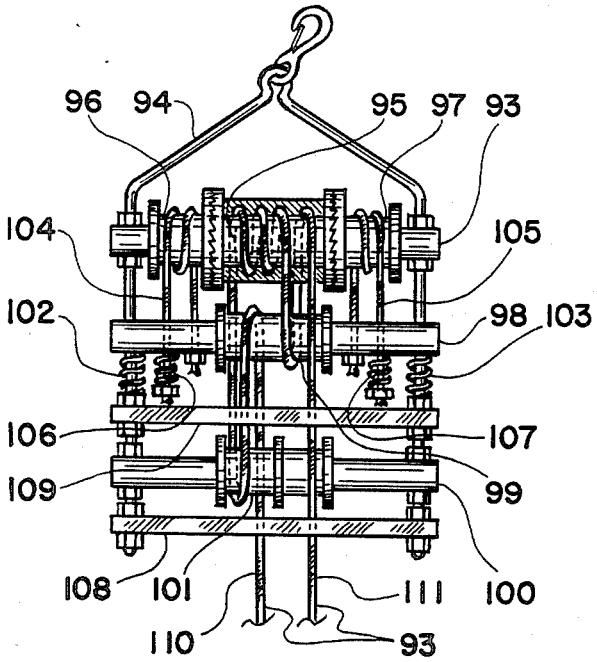
FIG. 13 illustrates a one-way frictionally controlled cord release device wherein the magnitude of frictional braking is controlled by the weight of person using it.

In FIG. 13 there is shown a one-way frictionally controlled cord release device wherein the weight of the closed loop of cord 93 itself does not create any frictional braking, that comprises a first shaft 93 affixed to the supporting structure 94 and rotatably supporting a friction roller cylinder 95 and a pair of the brake roller cylinders 96 and 97 assembled in the same way as the corresponding assembly included in the device shown in FIG. 9, 11 or 12. A second shaft 98 rotatably supporting a first idler roller 99 is disposed parallel to the first shaft 93 and movably secured to the supporting structure. A third shaft 100 rotatably supporting a second idler roller 101 is disposed parallel to the first shaft 93 and immovably secured to the supporting structure 94. The location of the second shaft 98 movably disposed intermediate the first shaft 93 and the third shaft 100 is spring biased by a pair of compression springs 102 and 103 disposed intermediate the second shaft 98 and the third shaft 100. The pair of brake cords 104 and 105 respectively wound on the pair of brake roller cylinders 96 and 97 are anchored to the second shaft 98 wherein the anchoring thereof is spring biased by a pair of compression springs 106 and 107. A pair of cord guide plates including holes guiding the cord members are affixed to the supporting structure 94 in a configuration sandwiching the second idler roller 101. The first cord member 110 of the closed loop of cord 93 depending from the friction roller cylinder 95, which cord member supports a person secured thereto, is looped around the combination of the first idler roller 99 and the second idler roller 101 and routed back downward, while the second cord member 111 of the closed loop of cord 93 depending from the friction roller cylinder 95 is looped around the combination of the friction roller cylinder 95 and the first idler roller 99 and routed back downward. As the second shaft 98 anchoring the brake cords 104 and 105 is tugged by the two cord members 110 and 111 in two opposite directions, the weight of the closed loop of cord 93 itself does not create any frictional braking. The frictional braking against the looping motion of the closed loop of cord in one direction resulting in the downward movement of the first cord member 110 is created by the weight of a person secured to the first cord member 110 only in magnitude substantially proportional to and slightly less than the weight of that person, while the looping motion of the closed loop of cord in the other direction resulting in the downward movement of the second cord member 111 is unhindered by any frictional braking because of the ratchet coupling intermediate the friction roller cylinder 95 and the brake roller cylinders 96 and 97. The device shown in FIG. 13 may be employed in place of the element 34 included in the sky-ride vertical mobility system shown in FIG. 6.

Figure 14:
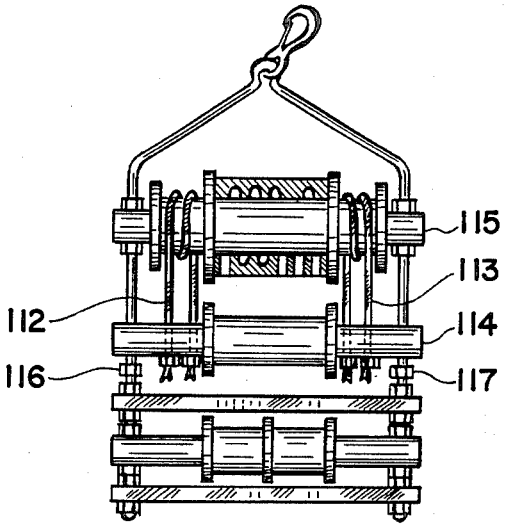
FIG. 14 illustrates a one-way frictionally controlled cord release device wherein the magnitude of frictional braking controlled by the weight of person using it is set to a value less than a preset maximum value.

In FIG. 14 there is illustrated a frictionally controlled cord release device constructed essentially in the same way as the device shown in FIG. 13 with two exceptions being that, firstly, the pair of brake cords 112 and 113 are anchored to the second shaft 114 without any compression spring bias and, secondly, a pair of rigid stops 116 and 117 employed in place of a pair of compression spring biases limit the movement of the second shaft 114 away from the first shaft 115. The resiliency of the brake cords 112 and 113 provides the frictional braking force varying in proportion to the weight of the person secured to the first cord member of the closed loop of cord, that is now set to values less than the maximum set forth by the location of the pair of rigid stops 116 and 117. It should be noticed that the pull of the second cord member of the closed loop of cord with a tension exceeding that on the first cord member completely relaxes the braking cords as there is no compression spring biases on the braking cords and, consequently, the closed loop of cord can be freely looped in a direction resulting in the down-ward movement of the second cord member, even when the friction roller cylinder and the brake roller cylinder are rigidly connected to one another. Such a condition can be obtained with the device shown in FIG. 13 by employing an appropriate combination of the length of the two different types of bias springs that eliminates the need of the ratchet couplings.

Figure 15:
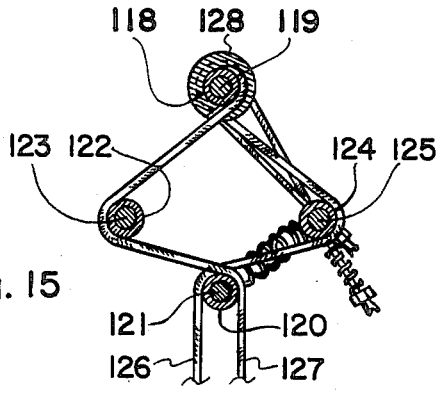
FIG. 15 illustrates a cross section of another embodiment of the one-way frictionally controlled cord release device wherein the magnitude of frictional braking is controlled by the weight of person using it.

In FIG. 15 there is illustrated a cross section of a frictionally controlled cord release device comprising a friction roller cylinder 118 rotatably supported by a first shaft 119, a first idler roller 120 rotatably supported by a second shaft 121, a second idler roller 122 rotatably supported by a third shaft 123 and a third idler roller 124 rotatably supported by a fourth shaft 125. The first cord member 126 depending from the friction roller cylinder 118 with a tubular cord guide 128 is routed around the third idler roller 124 and then around one side of the first idler roller 120, while the second cord member 127 depending from the friction roller cylinder 118 is routed around the second idler roller 122 and then around the other side of the first idler roller 120.

Figure 16:
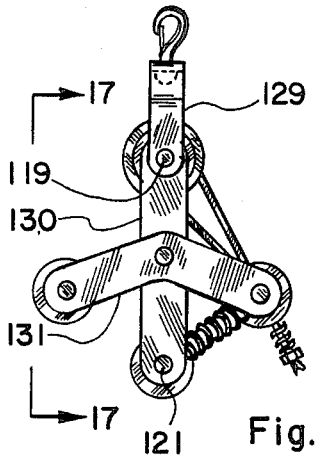
FIG. 16 illustrates a side elevation view of the device shown in FIG. 15.

In FIG. 16 there is illustrated a side elevation view of the device shown in FIG. 15 wherein the closed loop of cord is omitted from the illustration for clarity of the presentation. The first shaft 119 is affixed to a supporting structure 129 with a securing means for anchoring to an elevated structure, while the second shaft 121 is supported by the free extremity of a pair of pendulous structures 130 depending from the first shaft 119. The third shaft 123 and the fourth shaft 125 are respectively supported by two extremities of a pair of lateral structures 131, which are pivotably connected at the mid-length thereof to the pair of the pendulous structures 130 intermediate the first shaft 119 and the second shaft 121.

Figure 17:
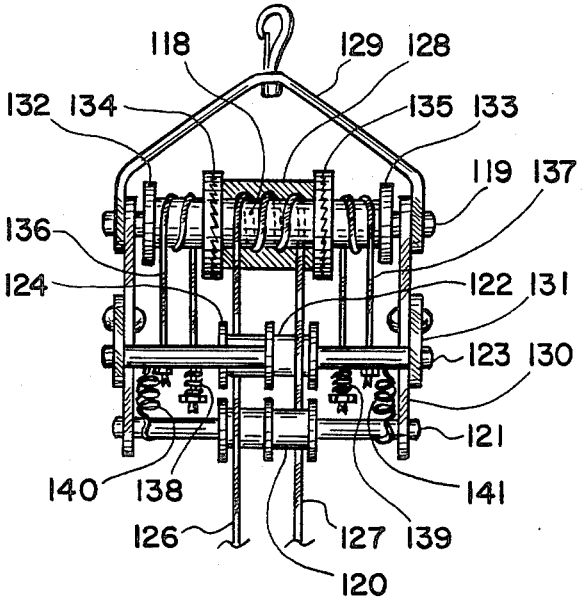
FIG. 17 illustrates a front elevation view of the device shown in FIG. 16.

In FIG. 17 there is illustrated a front elevation view of the device shown in FIG. 16 viewed across plane 17—17 as shown in FIG. 16. A pair of the brake roller cylinders 132 and 133 are also rotatably supported by the first shaft 119, which brake roller cylinders are coupled to the friction roller cylinder 118 by a pair of ratchet couplings 134 and 135. The pair of brake cords 136 and 137 respectively wound on the pair of brake roller cylinders 132 and 133 are secured to the fourth shaft 125 with a pair of compression spring biases 138 and 139. The second shaft 121 and the fourth shaft 125 are spring biased against a movement therebetween toward one another by a pair of compression springs 140 and 141. The looping motion of the closed loop of cord in one direction resulting in the downward movement of the first cord member 126 is hindered by frictional braking, wherein the magnitude thereof independent of the weight of the closed loop of cord is a function of the weight of the person secured to the first cord member 126, while the looping motion of the closed loop of cord in the other direction resulting in the downward movement of the second cord member 127 is unhindered by frictional braking because of the ratchet couplings 134 and 135. As a matter of fact, the device shown in FIG. 17 operates in the same principle as the device shown in FIG. 13.

Figure 18:
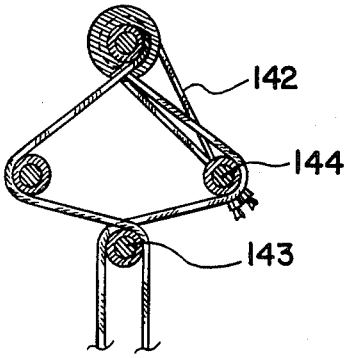
FIG. 18 illustrates a cross section view equivalent to that of FIG. 15 of a further frictionally controlled cord release device.

In FIG. 18 there is illustrated cross section equivalent to that shown in FIG. 15 of another frictionally controlled cord release device that does not employ the compression spring bias on the brake cords 142 as well as the compression spring bias between the second shaft 143 and the fourth shaft 144.

Figure 19:
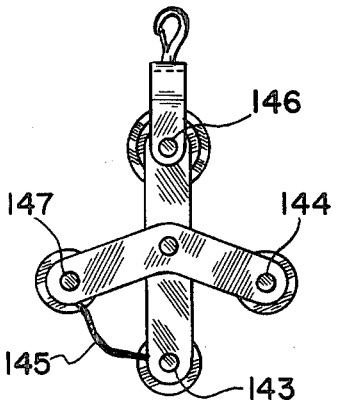
FIG. 19 illustrates a side elevation view equivalent to that of FIG. 16 of the device illustrated in FIG. 18.

In FIG. 19 there is illustrated a side elevation view equivalent to that shown in FIG. 16 of the device shown in FIG. 18 that employs a stop cord 145 tethering the second shaft 143 to the third shaft 147 that limits the relative movement between the first shaft 146 and the fourth shaft 144 from one another and, thus, limiting the magnitude of the braking force under a preset maximum value. The frictionally controlled cord release device shown in FIGS. 18 and 19 operates in the same principle as that of the device shown in FIG. 14.

Figure 20:
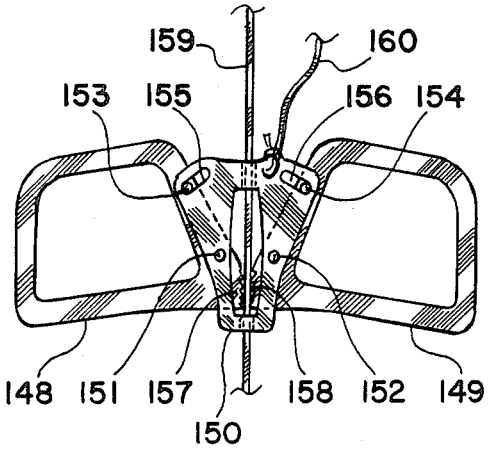
FIG. 20 illustrates a stirrup device usable in conjunction with an embodiment of the present invention as shown in FIG. 6.

In FIG. 20 there is illustrated a stirrup device comprising a pair of foot supports 148 and 149 pivotably connected to a cord guide 150 by means of a pair of pins 151 and 152, respectively. The pair of guide pins 153 and 154 respectively affixed to the foot supports 148 and 149 and respectively engaging a pair of slotted holes 155 and 156 disposed in the cord guide 150 limit the pivoting movement of the foot supports 148 and 149. The foot supports 148 and 149 respectively include the cord grabbers 157 and 158 which grab the cord 159 when the foot supports 148 and 149 are pressed down. A tether cord 160 extending from the cord guide 150 is to tether the stirrup device shown in FIG. 20 to the securing means 39 affixed to the cord member 37 shown in FIG. 6. Of course, the stirrup device shown in FIG. 20 is for use in place of the element 40 shown in FIG. 6.

Figure 21:
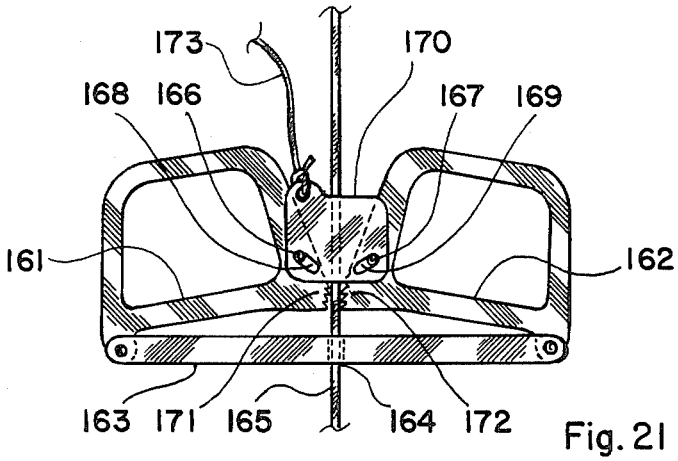
FIG. 21 illustrates another embodiment of the stirrup device.

In FIG. 21 there is illustrated another stirrup device comprising a pair of foot supports 161 and 162 pivotably connected to two extremities of a support bar including a cord guide hole 164 disposed in the mid-section thereof, which hole is slidably engaged by the cord. A pair of guide pins 166 and 167 respectively affixed to the foot supports 161 and 162 respectively engage a pair of slotted holes 168 and 169 disposed in a cord guide 170. The foot supports 161 and 162 include the cord grabber 171 and 172 which grabs the cord 165 when the foot supports 161 and 162 are pressed down. The tether cord 173 extending from the cord guide 168 is to secure the stirrup device within the reach of the person using the sky-ride vertical mobility system at all instances.

It should be understood that the actual means for providing the frictional braking on the friction roller cylinder, on which the cord member is wound, that is activated by the sum of pulls exerted on the two cord portions of the cord member or the difference between pulls exerted on the two cord portions of the cord member may employ embodiments different from that used in the illustrated embodiments, which may be a multiple disc brakes including means of activation by the pulls on the cord members or other types of braking device available in present day industry. The selection of specific type of braking and its installation in conjunction with the present invention is considered a matter of design that does not effect the merit and novelty of the present invention.

While the principles of the present invention have now been made clear by the illustrative embodiments, it will be immediately obvious to those skilled in the art many modifications of the structures, arrangement, proportion, elements and materials which are particularly adapted to the specific working environments and operating conditions in the practice of the invention without departing from those principles.

We claim:

1. A vertical mobility device for transporting a person between a higher elevation and a lower elevation comprising in combination:

(a) a frictionally controlled cord release device including; a first cylindrical member rotatably and nonshiftably secured to a supporting structure including a means for securing said supporting structure to an elevated structure; a second cylindrical member rotatably and nonshiftably secured to said supporting structure; and a third cylindrical member rotatably and shiftably secured to said supporting structure intermediate said first and second cylindrical members in a substantially parallel relationship with respect to said first and second cylindrical members;

(b) a cord member wound on said first cylindrical member over at least one and one half laps, wherein one portion of said cord member extending from one side of the cylindrical surface of said first cylindrical member loops over the combination of said second and third cylindrical members over at least one complete loop, and the other portion of said cord member extending from the other side of the cylindrical surface of said first cylindrical member loops over the combination of said third and first cylindrical members over at least one complete loop;

(c) at least one brake cord wound on at least one extremity of said first cylindrical member over at least one half lap wherein both extremities of said brake cord are secured to a member shifting with said third cylindrical member; wherein said brake cord produces a brake force hindering rotating movement of said first cylindrical member when tension on said one portion of said cord member is greater than tension on said the other portion of said cord member;

(d) cord guide means for guiding said cord member wound on said first cylindrical member;

(e) at least one securing means affixed to said one portion of said cord member depending from said frictionally controlled cord release device for securing a person to said one portion of said cord member;

(f) at least one stirrup means slidably secured to said the other portion of said cord member depending from said frictionally controlled cord release device, said stirrup means including a pressure activated grip means wherein said grip means grabs said cord member in a nonslidable relationship when said stirrup means is stepped on, while said stirrup means slides substantially freely when said stirrup means does not support a weight;

whereby a person secured to said one portion of said cord member can remain suspended in midair or lower oneself at a safe speed by exerting a small amount of tension on said the other portion of said cord member as said braking force plus said small amount of tension on said the other portion of said cord member substantially counter balances tension on said one portion of said cord member created by weight of said person and said person can elevate oneself by standing up on said stirrup means and then pulling up stirrup means by bending knees while maintaining a small amount of tension on said the other portion of said cord member.

2. The combination as set forth in claim 1 wherein said securing means for securing a person to said one portion of said cord member includes a harness removably secured to said one portion of said cord member.

3. The combination as set forth in claim 2 wherein extremity of said one portion of said cord member is connected to extremity of said the other portion of said cord member, wherein said cord member forms a closed loop of cord depending from said frictionally controlled cord release device.

4. The combination as set forth in claim 1 wherein extremity of said one portion of said cord member is connected to extremity of said the other portion of said cord member, wherein said cord member forms a closed loop of cord depending from said frictionally controlled cord release device.

5. The combination as set forth in claim 1 wherein said one extremity of said first cylindrical member lapped by said brake cord and a mid portion of said first cylindrical member which is lapped by said cord member are coupled by a ratcheting rotary coupling wherein said mid portion of said first cylindrical member is not rotatable in one direction relative to said one extremity of said first cylindrical member while said mid portion of said first cylindrical member is rotatable relative to said one extremity of said first cylindrical member in the other direction opposite to said one direction, wherein rotation of said mid portion of said first cylindrical member in said one direction releases said one portion of said cord member and takes up said the other portion of said cord member, while rotation of said mid portion of said first cylindrical member in said the other direction takes up said one portion of said cord member and releases said the other portion of said cord member.

6. The combination as set forth in claim 5 wherein said securing means for securing a person to said one portion of said cord member includes a harness removably secured to said one portion of said cord member.

7. The combination as set forth in claim 6 wherein extremity of said one portion of said cord member is connected to extremity of said the other portion of said cord member, wherein said cord member forms a closed loop of cord depending from said frictionally controlled cord release device.

8. The combination as set forth in claim 5 wherein extremity of said one portion of said cord member is connected to extremity of said the other portion of said cord member, wherein said cord member forms a closed loop of cord depending from said frictionally controlled cord release device.

9. A vertical mobility device for transporting a person between a higher elevation to a lower elevation comprising in combination:

(a) a frictionally controlled cord release device including; a first cylindrical member rotatably and nonshiftably secured to a supporting structure including a means for securing said supporting structure to an elevated structure; a second cylindrical member rotatably and nonshiftably secured to said supporting structure; and a third cylindrical member rotatably and shiftably secured to said supporting structure intermediate said first and second cylindrical members in a substantially parallel relationship with respect to said first and second cylindrical member;

(b) a cord member wound on said first cylindrical member over at least one and one half laps, wherein one portion of said cord member extending from one side of the cylindrical surface of said first cylindrical member loops over the combination of said second and third cylindrical members over at least one complete loop, and the other portion of said cord member extending from the other side of the cylindrical surface of said first cylindrical member loops over the combination of said third and first cylindrical members over at least one complete loop;

(c) at least one brake cord wound on at least one extremity of said first cylindrical member over at least one half lap wherein both extremities of said brake cord are secured to a member shifting with said third cylindrical member; wherein said brake cord produces a brake force hindering rotating movement of said first cylindrical member when tension on said one portion of said cord member is greater than tension on said the other portion of said cord member.

(d) cord guide means for guiding said cord member wound on said first cylindrical member;

(e) at least one securing means affixed to said one portion of said cord member depending from said frictionally controlled cord release device for securing a person to said one portion of said cord member; whereby, a person secured to said one portion of said cord member can remain suspended in midair or lower oneself at a safe speed by exerting a small amount of tension on said the other portion of said cord member as said braking force plus said small amount of tension on said the other portion of said cord member substantially counter balances tension on said one portion of said cord member created by the weight of said person.

10. The combination as set forth in claim 9 wherein said securing means for securing a person to said one portion of said cord member includes a harness removably secured to said one portion of said cord member.

11. The combination as set forth in claim 10 wherein extremity of said one portion of said cord member is connected to extremity of said the other portion of said cord member, wherein said cord member forms a closed loop of cord depending from said frictionally controlled cord release device.

12. The combination as set forth in claim 9 wherein said one extremity of said first cylindrical member lapped by said brake cord and a mid portion of said first cylindrical member which is lapped by said cord member are coupled by a ratcheting rotary coupling wherein said mid portion of said first cylindrical member is not rotatable in one direction relative to said one extremity of said first cylindrical member while said mid portion of said first cylindrical member is rotatable relative to said one extremity of said first cylindrical member in the other direction opposite to said one direction, wherein rotation of said mid portion of said first cylindrical member in said one direction releases said one portion of said cord member and takes up said the other portion of said cord member, while rotation of said mid portion of said first cylindrical member in said the other direction takes up said one portion of said cord member and releases said the other portion of said cord member.

13. The combination as set forth in claim 12 wherein said securing means for securing a person to said one portion of said cord member includes a harness removably secured to said one portion of said cord member.

14. The combination as set forth in claim 13 wherein extremity of said one portion of said cord member is connected to extremity of said the other portion of said cord member, wherein said cord member forms a closed loop of cord depending from said frictionally controlled cord release device.

* * * * *